US007018513B2

(12) United States Patent
Smith

(10) Patent No.: US 7,018,513 B2
(45) Date of Patent: Mar. 28, 2006

(54) SIPHON SUPPORT, SYSTEM AND METHOD FOR THE USE THEREOF

(76) Inventor: Jeffrey P. Smith, 1001 Wetherby Way, Alpharetta, GA (US) 30022

( * ) Notice: Subject to any disclaimer, the term of this patent is extended or adjusted under 35 U.S.C. 154(b) by 123 days.

(21) Appl. No.: 10/395,470

(22) Filed: Mar. 21, 2003

(65) Prior Publication Data

US 2004/0182534 A1 Sep. 23, 2004

(51) Int. Cl.
*D21F 5/10* (2006.01)

(52) U.S. Cl. ..... 162/375; 162/272; 34/119; 285/121.5; 165/91

(58) Field of Classification Search ..... 162/358.1, 162/358.5, 359.1, 206, 207, 262, 199, 272, 162/290, 361, 375, 381; 34/119, 124, 125, 34/454; 165/89–91; 285/121.3, 121.5, 121.1; 100/334, 335; 137/123; 138/177; 492/20, 492/46

See application file for complete search history.

(56) References Cited

U.S. PATENT DOCUMENTS 2,166,245 A * 7/1939 Goff et al. ..... 34/125
2,934,831 A * 5/1960 Tasker ..... 34/125
3,946,499 A * 3/1976 Schiel ..... 34/124
4,205,457 A * 6/1980 Sjostrand ..... 34/524
4,691,452 A * 9/1987 Ferguson ..... 34/119
4,792,164 A * 12/1988 Suemitsu ..... 285/121.4
5,533,569 A * 7/1996 Reibel et al. ..... 165/90
5,864,963 A * 2/1999 Komulainen ..... 34/124
6,203,072 B1 3/2001 Berghuis et al.

* cited by examiner

*Primary Examiner*—Eric Hug
(74) *Attorney, Agent, or Firm*—Schmeiser, Olsen & Watts

(57) ABSTRACT

The invention relates generally to an improvement to a rotary joint and stationary siphon system typically for use in the papermaking process. Disclosed is a siphon support that has a bearing that rotatably engages with a siphon and flow openings that allow for steam flow from the rotary joint to the interior of a heat exchange roll. Further disclosed is a support device with a flow section that receives steam from the rotary joint and transmits it on to the heat exchange roll, wherein the flow section raises the pressure differential across the rotary joint by less than about 2 p.s.i. The support device is also only attached to the rotary joint and siphon thereby reduces the cantilever effect of the stationary siphon. Further disclosed are systems for papermaking that include the siphon support and rotary joint; the siphon support and stationary siphon; and the support, rotary joint and siphon. Further disclosed is a method of assembly wherein the support device is attached to a rotary joint and siphon.

32 Claims, 8 Drawing Sheets

SIPHON SUPPORT, SYSTEM AND METHOD FOR THE USE THEREOF

BACKGROUND OF THE INVENTION

1. Technical Field

The invention relates to a device, system, and method, for use with a rotary joint and heat transfer cylinders used typically in the papermaking process. Generally, the device, a secondary bearing support, and a stationary siphon system which may employ it, improves the reliability and efficiency of various papermaking machines.

2. Related Art

A papermaking machine typically includes three main sections: Forming, Pressing and Drying. The raw material, called furnish, is largely water, and is converted to a sheet by these three sections. The first section, Forming, uses vacuum and other means to remove most of the water. At the same time, the fibers of the sheet are formed into the desired mat. The second section, Pressing, removes more water by pressing the sheet between felted rolls. The final phase of removing water from a sheet in a paper machine relies on heated cylinders, called dryers. The Drying frequently consumes more energy than any other section of the machine and, in many cases, more than any other operation in a papermaking mill.

One manner of drying the sheet is to use heated cylinders (a.k.a. dryers or cans). These rotating cylinders are heated by a heat transfer medium, typically this may be steam. A dryer section usually includes of many cans arranged in single or multiple tiers. The sheet is threaded through this arrangement of dryers, wrapping partially around a can and passing from can to can. The sheet is heated by the rotating dryer cans and most or all of the remaining water is evaporated from the sheet.

Several factors determine the rate of evaporation, or drying, of this remaining water within the sheet. One of these factors is the rate of transfer of the heat from the steam inside the dryer can to the exterior surface of the dryer can. As the sheet contacts a dryer, and the steam within the dryer is condensing, heat is transferred from the condensing steam inside the dryer through the dryer shell and into the sheet. A principle of heat transfer is that heat moves from higher temperatures to lower ones. The rate of this transfer depends on the temperature differential and the resistance to the heat transfer. A significant resistance to the transfer of the heat is the quantity of condensed steam, or condensate, inside the can.

A rotary joint, or union, is typically used as a junction point wherein fixed parts of the system meet, or have a junction with, rotating parts of the system. The rotating parts include the can itself and portions of the rotary joint. The fixed parts include other portions of the rotary joint and fixed piping attached to the rotary joint. The steam is supplied to the inside of the can typically through a portion of the rotary joint, or union. In some cases, the condensed steam (i.e., condensate) is evacuated through another portion of the same rotary joint, while in others it is removed through a second rotary joint. Since the condensate collects inside the dryer shell or cylinder, a siphon may be employed to remove the condensate from the shell. The siphon, with its inlet, or pickup, close to the interior surface of the dryer shell, is connected to the rotary joint by a horizontal pipe. The condensate is collected at a tip of the siphon inlet. The condensate then passes into the siphon; then through the horizontal pipe; and, finally through the rotary joint and to the fixed piping connected beyond.

Multiple forces must be overcome to remove the condensate from of the can. This is accomplished, in part, by creating a pressure differential. The pressure differential is typically measured between a steam inlet port leading into the rotary joint and a condensate outlet port, also located on the rotary joint. Optimally, the condensate is removed from the can at the same rate at which it is being created from the condensing steam, while concurrently being done with the lowest possible differential pressure. During normal operating conditions, some steam will also exit the dryer in the same manner as the condensate. This exiting steam is commonly referred to as "blowthrough steam". Blowthrough steam is undesirable.

Although condensate is being removed from the dryer can, the amount of condensate that remains in the dryer can at any time is determined, in part, by the distance between the siphon tip and the interior surface of the dryer can and the stability of this interface. The closer the siphon tip can be located to the surface of the dryer shell without contacting the shell, the more of the condensate can be removed from inside the dryer, and the smaller the quantity of condensate remains in the bottom of the inside of the dryer. Exacerbating this issue is that siphon tips also move. The siphon tip movement may be caused by movement in several areas including movement in: the rotary joint; the siphon assembly including both the horizontal and vertical pipe portions; the condensate; the rotating dryer can; paper machine vibration; or, a combination of these. Any reduction in this movement permits the siphon tip to maintain its close and consistent proximity with the condensate and to be placed closer to the interior surface of the can, thereby minimizing the amount of the condensate remaining in the can.

The behavior of the condensate inside the can is related to the rotating speed of the can. At very low speeds of rotation, the condensate puddles at the bottom of the can as a result of the forces of gravity. As the speed of rotation increases, however, the combination of centrifugal forces and the adhesion of the condensate to the interior surface of the dryer cylinder causes portions of the condensate puddle to move up the cylinder wall in the same direction as the rotation. This movement of condensate is called "puddling" or "cascading".

During speeds when the condensate is puddling or cascading, a stationary siphon can be used. The stationary designation results from the fact that the siphon is not rotating along with the can (Cf. other siphon designs, such as rotary siphons, which have a siphon which rotates along with the can). Two beneficial features of the stationary siphon include being able to permanently position the siphon tip close to the condensate puddle, and some stationary siphons may be installed and/or removed without personnel having to enter the dryer cylinder.

Inherent to the process of removing condensate from the can with a siphon, a portion of the supplied steam will also exit. The quantity of this blowthrough steam is determined, in part, by the magnitude of the differential pressure. In part, the amount of differential pressure is dictated by the flow restrictions in the siphon-rotary joint-piping assembly. Thus, the greater the flow restrictions in the assembly, the greater the requisite differential pressure to adequately pull condensate from the can. Unfortunately, the greater the differential pressure is, the greater amount of blowthrough steam that is also removed from the can.

Another deficiency in current stationary siphon systems is mechanical in nature. The entire siphon (i.e., both the horizontal and vertical portions of pipe) frequently is only singularly attached to the interior of the rotary joint at the very end of the horizontal pipe. The siphon may also be supported additionally at a second point close to the aforementioned single point of attachment. These types of siphon connections result in a cantilever of upwards of 50 inches. The cantilever, and the long vertical reach of the vertical portion of the siphon pipe, creates a significant moment arm and resultant stresses on various parts in the rotary joint, including, inter alia, seals and bearings.

In summary, a need exists to overcome the above stated, and other, deficiencies in the art.

SUMMARY OF THE INVENTION

It is an advantage of the invention to overcome the above deficiencies in the art.

For example, the present invention provides a stable stationary siphon system that when installed will allow the tip of the siphon to be placed close to the interior wall of the dryer cylinder.

Further, the present invention improves rotary joint life by transferring a portion of the siphon and horizontal pipe loads off of the rotary joint bearings and seals, which are wear parts of the joint.

Also, the present invention reduces the wear and failure of the joint and siphon system by reducing movement of the system in the dryer cylinder.

Also, the present invention improves fluid flow by reducing the movement of the siphon tip relative to the condensate puddle.

Also, the present invention minimizes the resistances to the flow of fluid through the siphon support.

Also, the present invention minimizes the required internal diameter of the dryer journal opening required for optimum fluid flow.

Also, the present invention allows the joint and siphon system to be completely assembled prior to installation in a dryer cylinder.

Also, the present invention can be employed with conventional rotary joint and siphon designs and commercial pipe for the horizontal pipe.

To overcome the aforementioned, and other, deficiencies, the present invention provides a siphon support, a system that employs the support, and method for installing the support In a first general aspect, the present invention provides an apparatus for use with a rotary joint and siphon comprising:

a siphon support having a first end and a second end, wherein said first end has an internal bearing surface for rotary engagement with said siphon, and wherein said siphon support includes an opening intermediate said first end and said second end for flow of fluid from an interior to an exterior of said siphon support.

In a second general aspect, the present invention provides in a stationary siphon system for rotating heat exchanger rolls having an axis of rotation and a journal concentric to the axis of rotation, said stationary siphon system further includes a rotary joint which includes an inlet port for providing a flow of fluid, said siphon system comprising:

a siphon support with a plurality of openings extending between an exterior and an interior of said siphon support, said plurality of openings adapted to allow said flow of fluid between said rotary joint and an interior of said journal; and a bearing rotatably attached to said siphon support.

In a third general aspect, the present invention provides a support device adapted for use with a rotary joint and stationary siphon system and rotating heat exchanger rolls having an axis of rotation and a journal concentric to the axis of rotation, wherein said rotary joint has an steam inlet pressure and a condensate outlet pressure wherein a pressure differential is measured between said inlet pressure and said outlet pressure, comprising:

a flow section adapted to receive steam from said rotary joint and transmit steam to said journal, wherein said flow section is further adapted to raise said pressure differential less than about 2 p.s.i.; and wherein said support device is only attached to a rotatable portion of said rotary joint and to a siphon pipe of said stationary siphon system.

In a fourth general aspect, the present invention provides for use in a stationary siphon system and at least one rotating roll having an axis of rotation comprising:

a hollow support having at least one opening extending between an exterior and an interior thereof, said at least one opening adapted to allow a flow of steam from said interior of the hollow support to an interior of a journal of said rotating roll, wherein a sum of all areas of the at least one opening is defined, $A_T$;

said hollow support being further adapted to allow for a return condensate pipe to pass through said hollow support, wherein $D_3$ is defined as an exterior diameter of said return condensate pipe; and said hollow support having a first interior diameter, $D_1$, and said hollow support further adapted so that: $A_T \geqq \pi(D_1^2 - D_3^2)/4 \pm 10\%$.

In a fifth general aspect, the present invention provides a support device adapted for use with a portion of a papermaking system, said system including a rotary joint, stationary siphon, and rotating heat exchange cylinder, wherein said stationary siphon is solely attached to a stationary portion of said rotary joint thereby creating a cantilever, said support device comprising:

a support point, wherein said support point reduces said cantilever by attaching said stationary siphon at a rotatable portion of said rotary joint; and said support device is only attached to said stationary siphon and said rotary joint.

In a sixth general aspect, the present invention provides a system for papermaking comprising:

a siphon support having a first end and a second end, wherein said first end has an internal bearing surface for rotary engagement with a siphon, and wherein said siphon support includes an opening intermediate said first end and said second end for flow of fluid from an interior to an exterior of said siphon support; and a rotary joint operatively attached to said siphon support.

In a seventh general aspect, the present invention provides a system for papermaking comprising:

a siphon support having a first end and a second end, wherein said first end has an internal bearing surface for rotary engagement with a siphon, and wherein said siphon support includes an opening intermediate said first end and said second end for flow of fluid from an interior to an exterior of said siphon support; and said siphon operatively attached to said siphon support.

In an eighth general aspect, the present invention provides a system for papermaking comprising:

a siphon support having a first end and a second end, wherein said first end has an internal bearing surface for rotary engagement with a siphon, and wherein said siphon support includes an opening intermediate said first end and said second end for flow of fluid from an interior to an exterior of said siphon support;

a rotary joint operatively attached to said siphon support; and said siphon operatively attached to said siphon support.

In an ninth general aspect, the present invention provides a method of assembly for use with a rotary joint and siphon system comprising:

attaching a siphon support to said rotary joint, wherein said siphon support has a first end and a second end, wherein said first end has an internal bearing surface for rotary engagement with a siphon of said siphon system, and wherein said siphon support includes an opening intermediate said first end and said second end for flow of fluid from an interior to an exterior of said siphon support;

attaching said siphon to said rotary joint; and placing said siphon through said siphon support.

The foregoing and other features and advantages of the invention will be apparent from the following more particular description of embodiments of the invention. It is to be understood that both the foregoing general description and the following detailed description are exemplary, but are not restrictive, of the invention.

BRIEF DESCRIPTION OF THE DRAWINGS

The features of the present invention will best be understood from a detailed description of the invention and an embodiment thereof selected for the purposes of illustration and shown in the accompanying drawings in which.

DETAILED DESCRIPTION OF THE INVENTION

Figure 1:
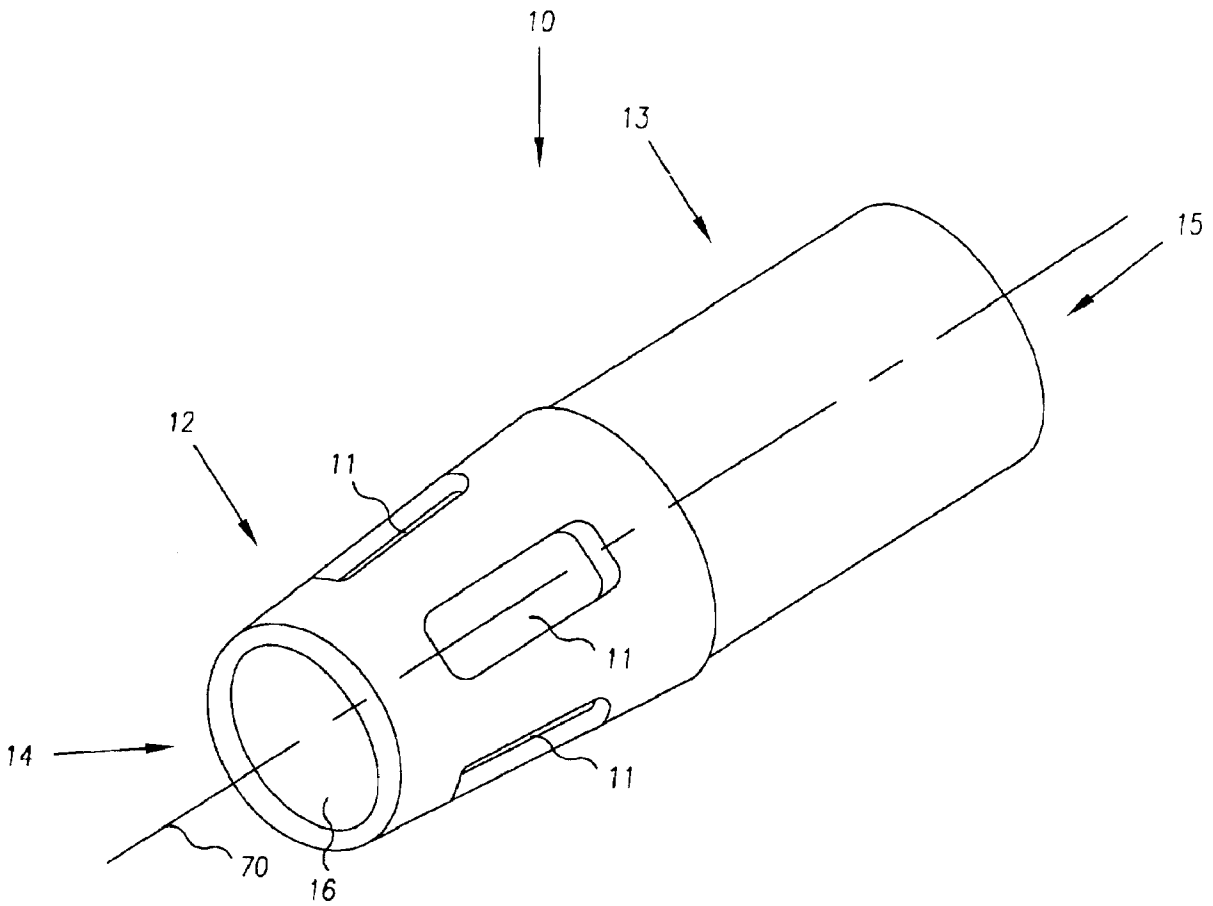
FIG. 1 is a perspective view illustrating an embodiment of a siphon support, in accordance with the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring now to the drawings, FIG. 1 illustrates a perspective view of an embodiment of a portion of the present invention, a siphon support, hereinafter designated as 10. This siphon support, support, or device 10, is hollow, or has a bore, thereby allowing a flow of fluid there through. As will be discussed below, steam is allowed to pass through (i.e., flow through) the device 10. A first section 12 of the device 10 may take the shape of a portion of a cone. In the embodiment illustrated in FIG. 1, the first section 12 is frusto-conical (i.e. frustum of a right cylinder cone). The first section 12 has a first end 14 with a bore having an interior surface 16. A second section 13 of the device 10 has a second end 15 with a bore therein. The second section 13 typically is a hollow right circular cylinder. Through the surface of the first section 12 is at least one flow opening 11. In the embodiment in which a frustum of a cone is the first section 12, the bore of the first end 14 is smaller than the bore at the second end 15. Thus, the smaller diameter end of the frustum on the first section 12 is distal to the second section 13. In alternative embodiments a plurality of flow openings 11 may be spaced symmetrically, or asymmetrically around the perimeter of the first section 12. In other embodiments (not shown), the first section 12 may be a cylinder (e.g., circular, elliptical, etc.). Various other geometries for the device 10 that are not shown, are possible wherein the functionalities of the device 10 still remain. An axial centerline of the device 10 is shown at 70.

Figure 2:
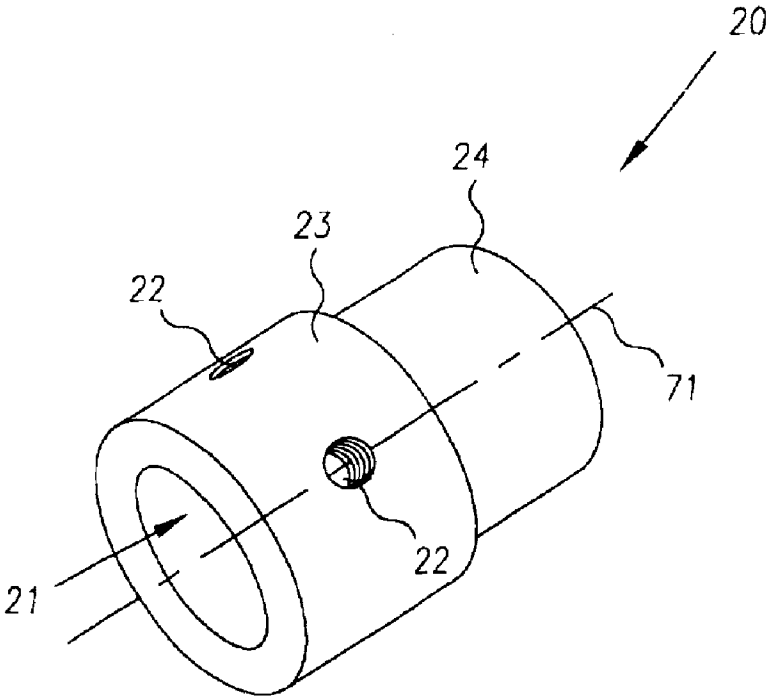
FIG. 2 is a perspective view illustrating an embodiment of a bearing portion, in accordance with the present invention.

FIG. 2 illustrates a perspective view of an embodiment of a bearing portion 20 of the present invention. The bearing, or bearing portion 20, which has a bore 21, is generally a hollow cylinder wherein two sections 23, 24 of the bearing 20 have different outside diameters. The first section 23 has a outside diameter that is larger than the outside diameter of the second section 24. Spaced on the surface of the first section 23 are a plurality of attachment openings 22, which allow for attachment of the bearing 20 to a horizontal pipe portion 32 (see FIG. 4) of a siphon 30. Bolts, such as allen-type bolts (not shown), may be used in the attachment openings 22 to secure the bearing portion 20 to the horizontal pipe 32. Several other methods of rigid attachment between the bearing portion 20 and the horizontal pipe 32 are available. For example, attachment may be by bolts, screws, welding, etc. The bearing portion 20 may be removably attached, or permanently fixed, to the horizontal pipe 32. For example, in an alternative embodiment (not shown) the bearing portion 20, or a similar bearing surface, may be machined into (i.e., made integral with) the external surface of the horizontal pipe 32. An axial centerline of the bearing portion 20 is also shown at 71.

Figure 3:
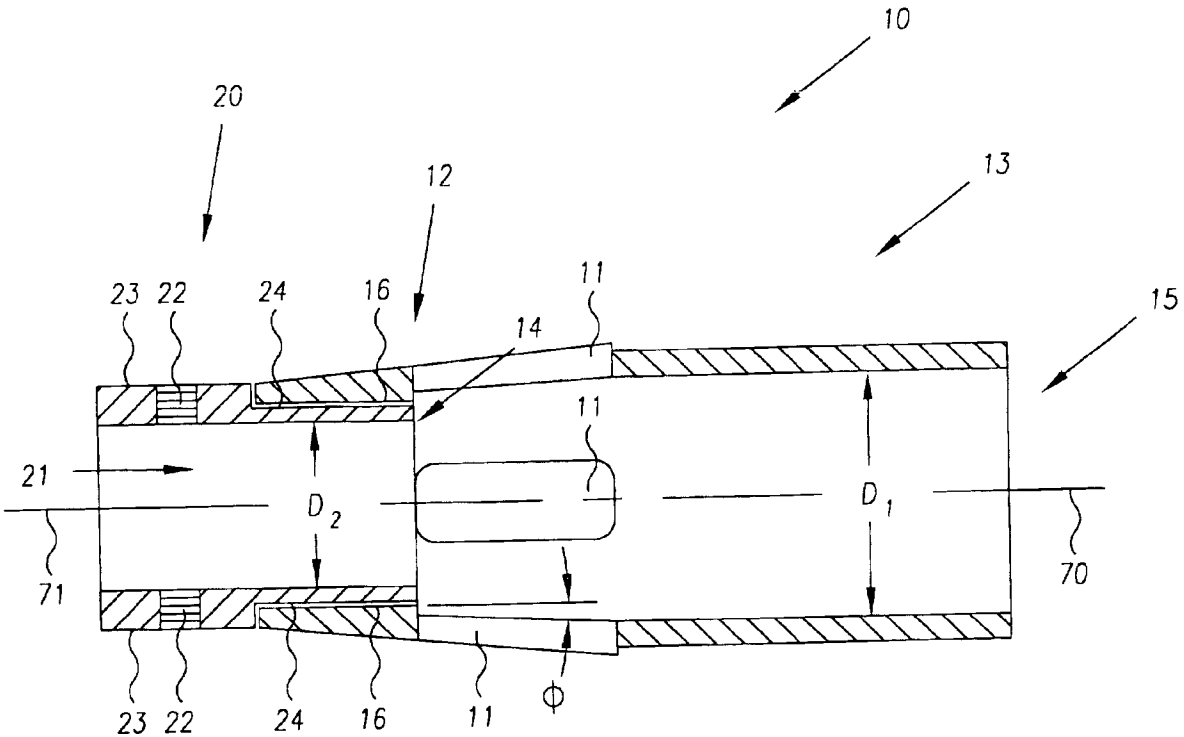
FIG. 3 is a elevational sectional view illustrating an embodiment of a siphon support and bearing portion, in accordance with the present invention.

The sectional view in FIG. 3 shows both device 10 and bearing 20 and their interface when in use. The second section 24 of the bearing 20 is placed within the bore of the first end 14 of the device 10. Thus, the external surface of the second section 24 bears on, contacts, or may be proximal yet not touching, the adjacent interior surface 16 of the bore of the first end 14 of the first portion 12 of the device 10. The diameter of bore of the second end 15, is denoted as $D_1$. The diameter of bore 21, of bearing 20, is denoted by $D_2$. The attachment points 22 of the bearing 20 allows for removable attachment of bearing 20 to the horizontal pipe 32 via attachment means (not shown). Contrastingly, while bearing 20 is fixed to the horizontal pipe 32, the device 10 is free to rotate around the second section 24 of the bearing 20. In the embodiment shown, the axial centerlines 70, 71 of both parts 10, 20 are coaxial. In alternative embodiments (not shown) the two parts 10, 20 can be eccentrically arranged.

Figure 4:
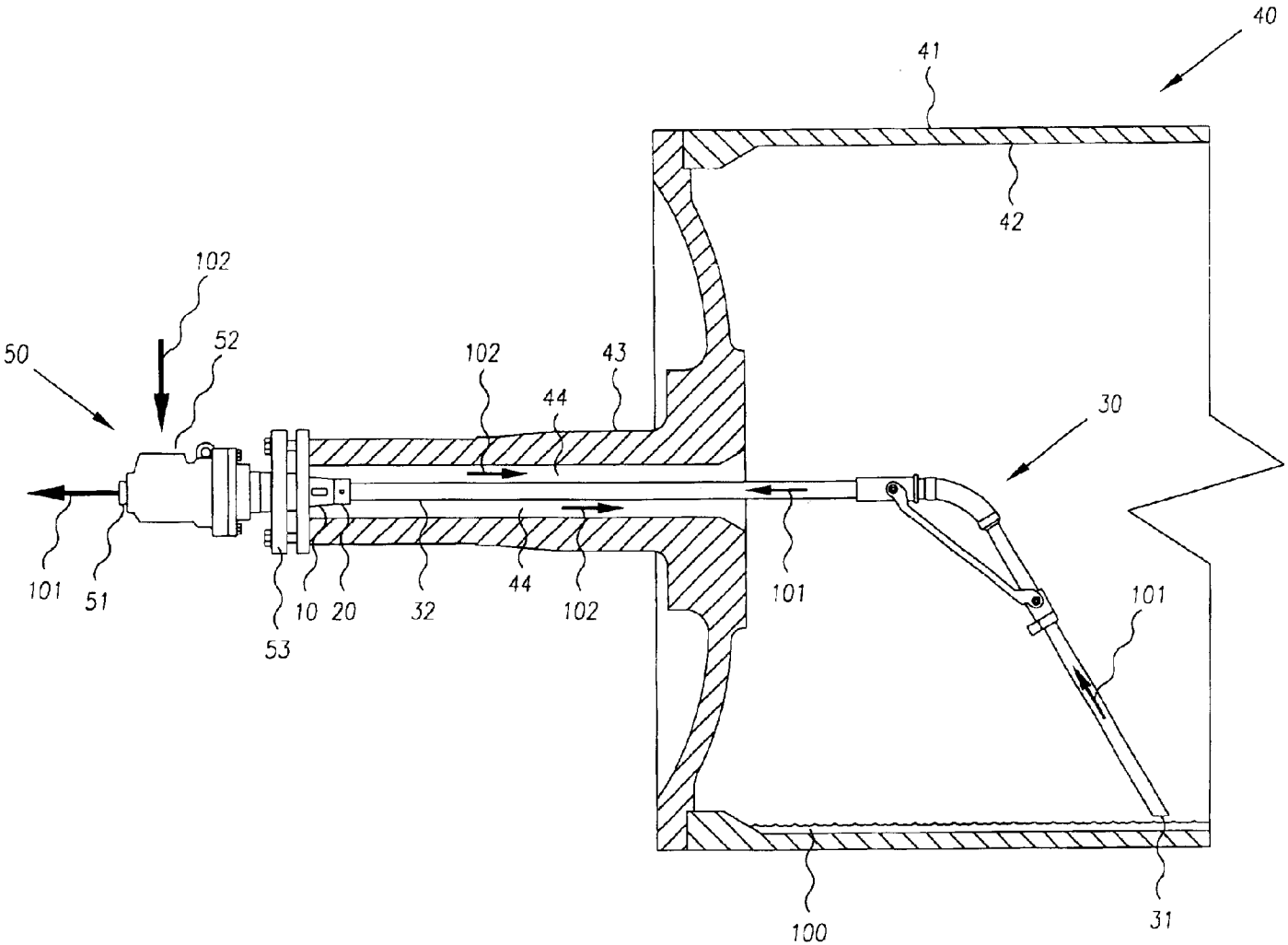
FIG. 4 is a elevational partially sectional view illustrating a rotary joint and siphon system utilizing an embodiment of the invention, in accordance with the present invention.

The present invention which provides for an improvement for rotary joint and siphon systems is shown in the installed position in FIG. 4 in this partial elevation, partially sectional view. The joint and siphon system, or assembly, includes a rotary joint 50, a siphon support 10, and bearing 20 and a siphon 30. The siphon 30 includes a horizontal pipe portion 32 and a vertical, or predominantly vertical pipe portion connected therewith. At the distal end of the vertical pipe portion of the siphon 30 is a siphon tip 31. The joint and siphon assembly is typically connected to a dryer journal 43 by a flange 53. In alternative embodiments (not shown), attachment of the joint and siphon system to a dryer 40 by other means, such as threads and bolts, etc. is possible. A dryer 40 (i.e., cylinder or can) is essentially a rotating drum, or cylinder. The dryer 40 is a cylindrical shell having an exterior surface 41 and an interior surface 42. Extending along the axis of rotation of the dryer 40 is a dryer journal 43. Within the dryer journal 43 is a journal annulus opening 44, within which runs the horizontal pipe portion 32 of a siphon 30. Generally connected to the end of the dryer journal 43 is a rotary joint 50, which, in turn, is connected to various fixed piping (not shown). Steam is supplied via an inlet 52 to the rotary joint 50. The condensate leaves the rotary joint 50 via an outlet 51. Thus, the flow of steam, denoted by 102, is from the inlet 52, through portions of the rotary joint 50, through the device 10, through the journal annulus opening 44, to the interior of the dryer 40 beyond. As the steam condenses into condensate it forms a puddle of condensate 100 in the bottom on the dryer 40. The flow of condensate and blowthrough steam, denoted by 101, is conversely from the condensate puddle 100, into a siphon tip 31 and up the vertical portion of the siphon 30, then through the horizontal pipe portion 32 of the siphon 30 (which is surrounded by the bearing 20 and device 10), and then through portions of the rotary joint 50 on to the outlet 51. Note that while the return flow 101 through the siphon 30 is typically made up of condensate and a quantity of blowthrough steam, occasionally the return flow 101 may comprise entirely of blowthrough steam, or entirely condensate, depending on operating conditions.

Figure 5:
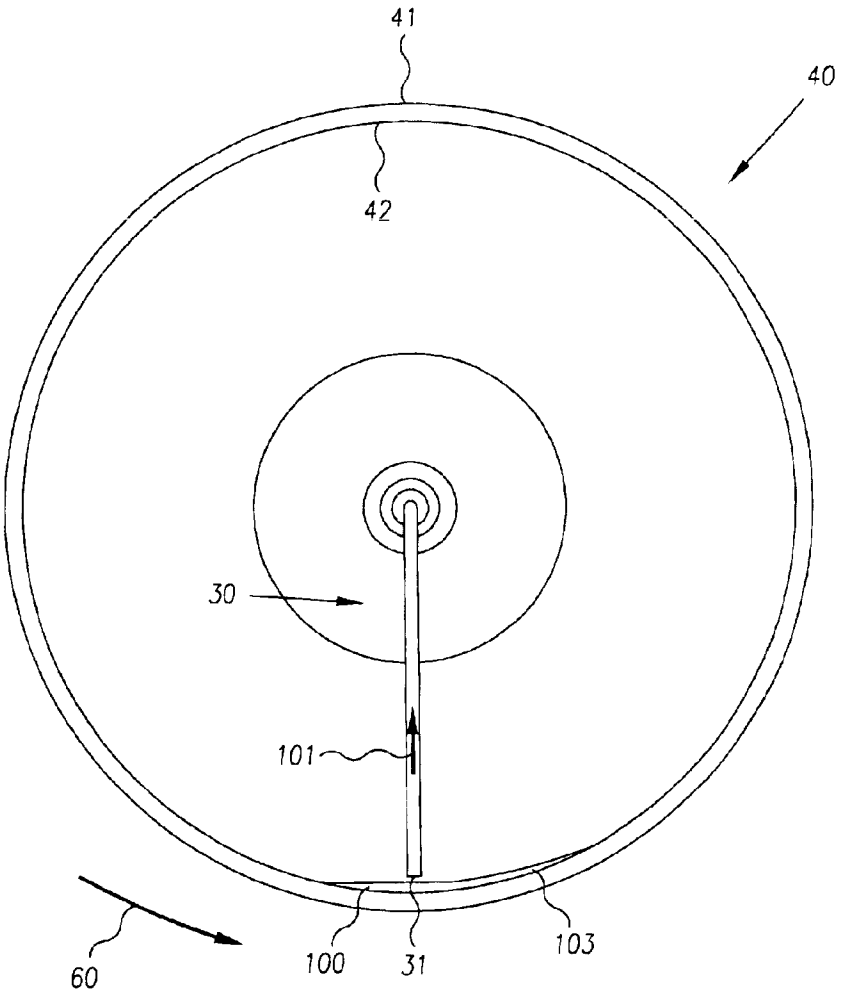
FIG. 5 is an elevational detail sectional view taken through the dryer cylinder illustrating a rotary joint and siphon system and typical behavior of condensate.

As the sheet (not shown) contacts the exterior surface 41, heat is transferred from the cylinder 40 to the sheet. The steam inside the dryer 40 replenishes the heat transferred to the sheet. As the steam contacts the interior surface 42 of the dryer cylinder 40, it releases heat and eventually becomes a liquid or condensate 100. The condensate 100 is evacuated from the dryer 40 by a siphon 30. As shown in FIG. 5, the rotation of the dryer 40, as denoted by directional arrow 60, causes at least a portion of the condensate 100 puddle formed on the bottom of the dryer 40 to begin to climb the interior surface 42 of the dryer 40 as the speed of rotation of the dryer 40 increases. The climbing, or creep, of the condensate 100 is denoted 103.

Figure 6:
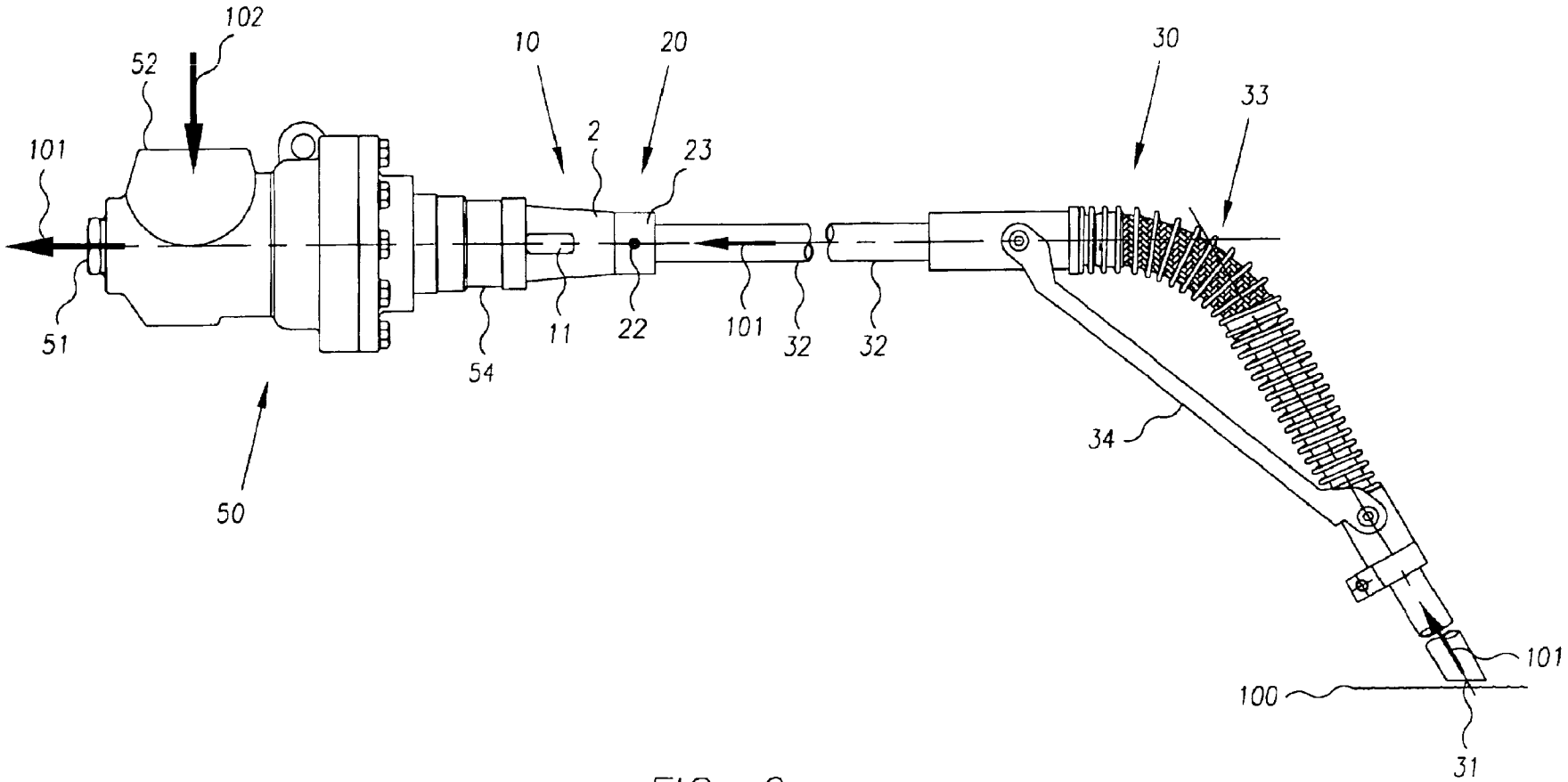
FIG. 6 is an exterior elevational view illustrating a rotary joint and siphon system with an embodiment of the invention, in accordance with the present invention.
Figure 7:
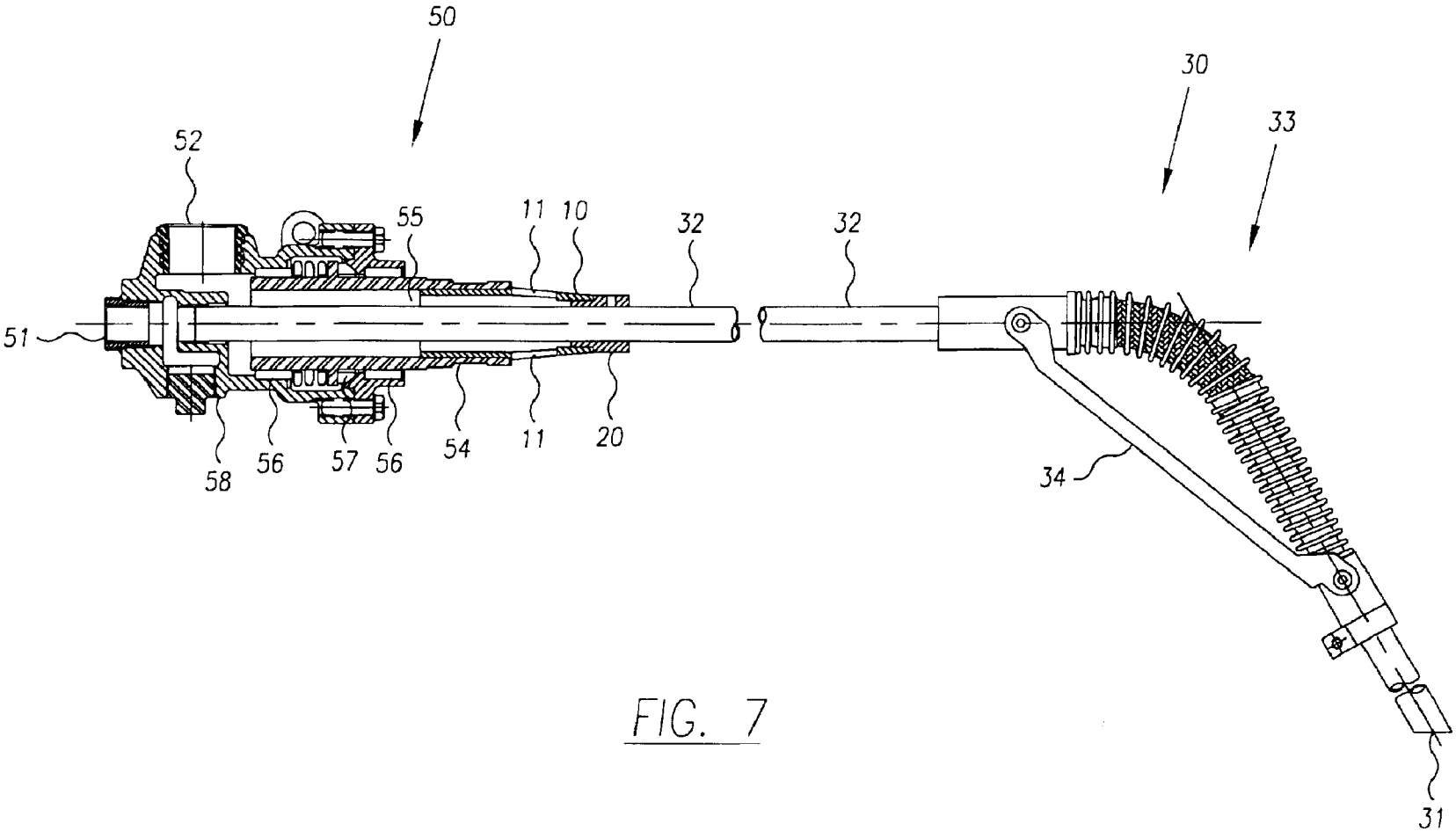
FIG. 7 is a elevational partially sectional view illustrating a rotary joint and siphon system with an embodiment of the invention, in accordance with the present invention.

The entire rotary joint and siphon system, including the siphon support 10 and bearing 20 are shown in the elevational view of FIG. 6 and the sectional elevational view of FIG. 7. A steam source (not shown) is connected to the inlet 52 of the rotary joint 50. The steam flow 102 is through the rotary joint 50 in an interstitial passageway 59 between the rotary joint body 50 and the horizontal pipe 32. The openings 11 in the siphon support 10 allow the steam to flow to the journal annulus opening 44, and the interior of the dryer 40 beyond. The condensate flow 101 is from the siphon tip 31 of the siphon 30, up the vertical portion of the siphon 30, through the horizontal pipe portion 32 of the siphon 30, and exits the rotary joint 50 at the outlet 51.

The rotary joint 50 may have an internal spider 55, or sleeve, in contact with the horizontal pipe 32. The rotary joint 50 inter alia has a stationary portion 58, a rotating portion 54, one or more bearings 56, and one or more seals 57. The stationary portion 58 of the rotary joint 50 is supported by the bearing 56, which also contacts the rotating portion 54. The seals 57 are also in contact with the stationary portion 58 and the rotating portion 54. Thus, the bearing 56 and the seal 57 are wear parts in the rotary joint 50. With the addition of device 10 and bearing 20 an additional horizontal support point is provided to the siphon 30. As a result, the moment arm created by the cantilever of the siphon 30 and the vertical portion of the siphon 30 is decreased and the resultant stresses on the various wear, and contact, points within the rotary joint 50 are lessened.

Figure 8:
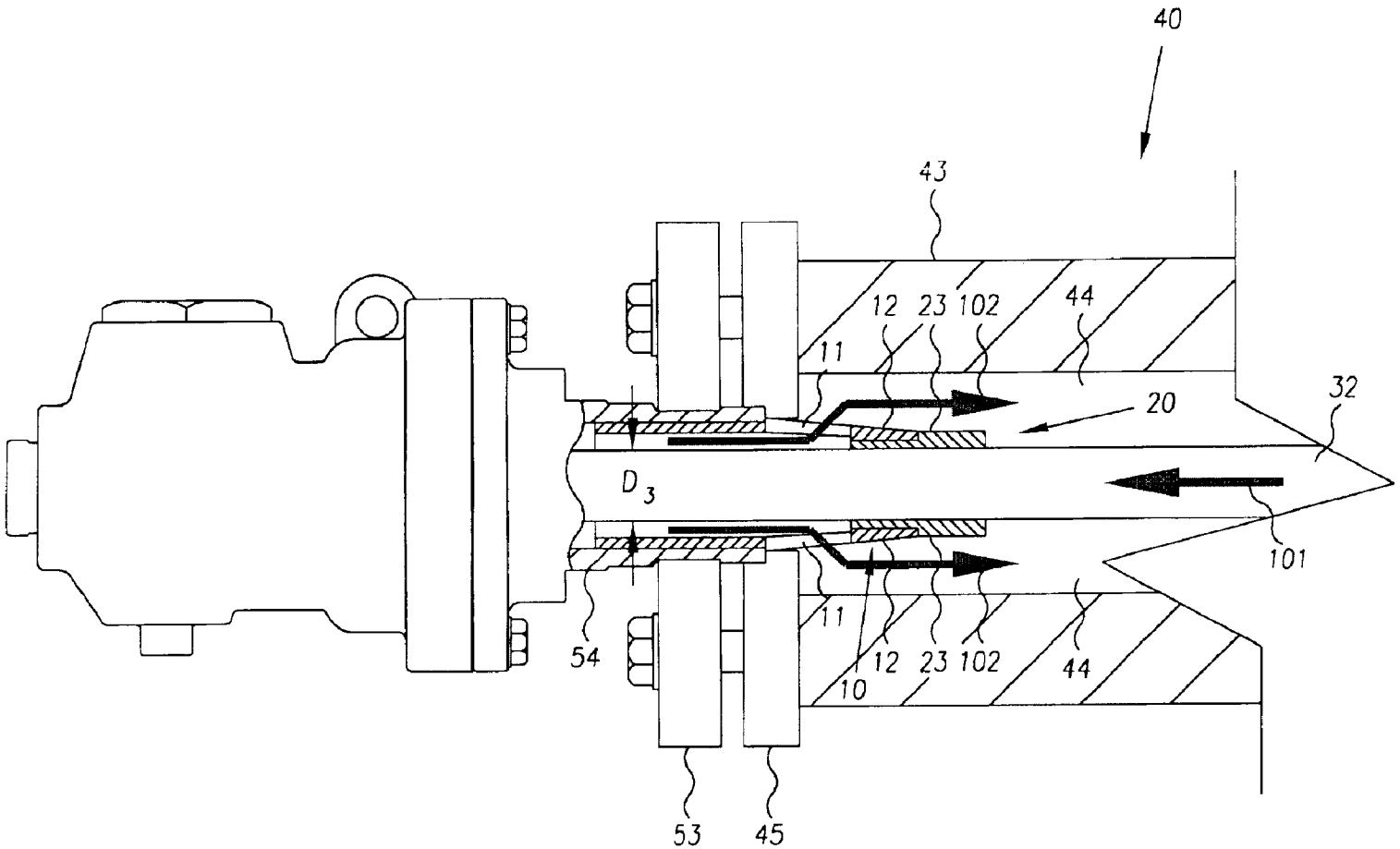
FIG. 8 is a close-up sectional elevation view illustrating a portion of the rotary joint and a stationary siphon system utilizing the invention, in accordance with the present invention.

A close up elevation sectional view of an embodiment of the invention is shown in detail in FIG. 8. FIG. 8 thus represents one of several possible configurations for the invention. A mounting plate 45 is attached to a face of the dryer journal 43. The rotating portion 54 of the rotary joint 50 is held firmly in place against the mounting plate 45 by a flange 53 or other suitable means. FIG. 8 shows the siphon support 10 of which the exterior of the second portion 13 tightly fits into the rotating portion 54 of the rotary joint 50. Other means (not shown) are practical for aligning the secondary siphon support 10 with the rotating portion 54 of the rotary joint 50. The siphon support bearing 20 is firmly attached to the horizontal pipe 32. The siphon support bearing 20, in turn, fits within the siphon support 10. Thus, the entire configuration allows for the siphon 30 including the horizontal pipe 32, along with the device 10 and bearing 20, and rotary joint 50 to be an entire assembly. The openings 11 in the siphon support 10 allow for the steam to flow 102 from rotary joint 40 to the journal annulus opening 44.

In order to improve fluid flow (i.e., lessen turbulence, increase or maximize flow, etc.) a pipe system should, inter alia, decrease the quantity of bends in the pipe system, lessen the magnitude of any bends in the pipe system (i.e., decrease the angles in the bends), and avoid narrowing of passageways in the pipe system. Thus, improved fluid flow can be obtained by, for example, avoid having any bends in the pipe system of 90° or more. Conversely, by narrowing passageways resistance is built up against the fluid flow. In the present use, a narrowing of passageways results in an increase in the aforementioned pressure differential. This increase, in turn, has the deleterious effect of increasing the volume of blowthrough steam picked up by the siphon 30. Measured pressure differentials in the art, without the installation of the present invention, typically are of the magnitude of about 3 to 4 psi measured between steam inlet and condensate outlet. The unique shape and configuration of the present invention, when added to a rotary joint and siphon system, does not increase the aforementioned pressure differentials measurably. The invention increases the pressure differential by less than about 2 psi. Thus, an advantage of the present invention, is that the pressure differential remains close to the original range of about 3 to 4 psi. As FIG. 8 illustrates the device 10, by virtue of the conical shape of the first section 12, the flow of steam 102 is unimpeded as the steam passes from the annular space between the second section 13 and the horizontal pipe 32 on to the journal annuls opening 44. As FIG. 3 shows, the interior wall of the first section 12 of the device forms an angle $\phi$ with a line parallel to the midline axis 70 of the device 10. Fluid flow restrictions can be diminished by having small angle $\phi$. For example, the angle $\phi$ may be set to less than 90°. Further, there may be one or more openings 11 in the siphon support 10. The total area of the openings 11 is sized so as to not reduce, impede, or restrict, the steam flow 102. The sum total area of the openings 11 is denoted as $A_T$. Referring to FIG. 8, $D_3$ is defined as the outside diameter of the horizontal pipe 32 in the region where the horizontal pipe 32 passes through either the rotating portion 54 of the rotary joint 50 and/or the second portion 13 of the siphon support 10. Thus, in order to maintain good fluid flow characteristics, the openings 11 on the siphon support 10 is sized (referring to both FIG. 3 and FIG. 8) according to Equation 1, as follows:

$$A_T \geqq \pi(D_1^2 - D_3^2)/4 \pm 10\% \qquad \text{Equation 1}$$

Thus, the total area of the openings 11 are generally sized to equal, or exceed, the total area of the annular space between the interior surface of the second portion 13 and the exterior surface of the adjacent section of the horizontal pipe 32. An other embodiments of the invention, the device 10 and bearing support 20 together may be sized according to Equation 2, wherein $D_1$ and $D_2$ are referred to in FIG. 3:

$$A_T \geqq \pi(D_1^2 - D_2^2)/4 \pm 10\% \qquad \text{Equation 2}$$

A method of installation of the present invention is as follows:

A rotary joint and siphon system employing the present invention has an advantage over the prior art of being fully assembled prior to installation into the dryer cylinder 40 . Further, the assembly requires only attachment of the rotary joint 50 to the dryer 40. No additional attachment points of the assembly to exterior or interior parts of the dryer 40 (including the dryer journal 43) are required. This assembly can be accomplished following several procedures. One such procedure is to first attach the horizontal pipe 32 to the rotary joint 50. Most commonly, the rotary joint 50 has a female threaded fitting in the stationary portion 58 of the rotary joint 50. Both ends of the horizontal pipe 32 typically are threaded. One end of the horizontal pipe 32 can be in installed in the female threaded fitting of the rotary joint 50.

Next the siphon support 10 and bearing 20 can be installed. The device 10 and the bearing 20 are fabricated such that the bearing 20 can be inserted into the bore of the first end 14. The device 10 and bearing 20 interface may be lubricated. In alternative embodiments, this interface may be made from materials that do not require lubrication or are self-lubricating.

The bores at the first end 14 and second end 15 in the device 10 allow it to be assembled over the horizontal pipe 32 and positioned next to the rotary joint 50. The siphon support 10 is aligned concentrically with the rotating portion 54 of the rotary joint 50. This alignment can be accomplished by a sleeve of the cylinder portion 13 on the siphon support 10 that fits tightly into the bore on the rotating portion 54 of the rotary joint 50. The attachment of the support 10 to the rotary joint 50 should eliminate any movement between the two parts.

If the method of attachment of the rotary joint 50 to the dryer cylinder 40 involves a tight fitting bore and seat on the dryer journal 43, another manner of alignment is possible. The siphon support 10 may have a small shoulder having the same outer diameter as the end of the rotating portion 54 of the rotary joint 50. When installed, this shoulder will register in the same tight fitting bore and seat at the end of the rotary joint 50. The rotary joint 50 is held firmly to the dryer journal 43 using a flanged arrangement. The shoulder of the siphon support 10 will be firmly sandwiched between the end of the rotary joint 50 and the seat of the dryer journal bore when the flange 53 is tightened. To maintain alignment before installation, a small tight fitting lip (See e.g., FIG. 3) on the secondary siphon support 10 may be engaged in the bore of the rotating portion 54 of the rotary joint 50. Leaks at the point where the rotating portion 54 of the rotary joint 50 mates with the siphon support 10 and where the siphon support 10 (See e.g., FIG. 8) can be eliminated by using gaskets (not shown), or other suitable sealing mechanisms.

After the siphon support 10 has been installed on the rotary joint 50 and horizontal pipe 32, the bearing 20 can be installed. The internal bore 21 of the bearing 20 is dimensioned to accept the range of diameters found in commercial pipe. The bearing 20 slides over the end of the horizontal pipe 32 and the smaller external surface 24 of the bearing 20 fits into the siphon support 10. The bearing 20 is fixed in a concentric manner to the horizontal pipe 32. This can be accomplished in many manners. For example, a keyless mounting is possible.

Next a swivel, or hinge joint,33 and brace 34 and the vertical pipe section of the siphon 30 are attached to the free end of the horizontal pipe 32 usually via a threaded connection. The vertical pipe section of the siphon 30 is installed such that it will not rotate about the horizontal pipe 32 and that the siphon tip 31 will be in the desired orientation when the assembly is ultimately installed in the dryer cylinder 40. Note well that the siphon assembly (i.e., 30, 31, 32, 33, 34) shown is only one of several designs that can be installed in a dryer can 40 through the journal 43. For example, other siphon assemblies have different flex joint 33 configurations that those shown, while other assemblies have no brace 34.

Using the internal diameter of the dryer cylinder 40 as a guide, the optimum length of the vertical portion of the siphon 30 in the installed position can be determined. This vertical section of the siphon 30 can be fabricated to this optimum length. This fabrication can be done before or after assembly to the horizontal pipe 32.

With a stationary siphon 30 that incorporates a swivel or hinge 33 at its bending point, the entire rotary joint and siphon assembly (i.e. rotary joint 50, siphon 30 including horizontal pipe 32, and support 10 and bearing 20) can then be installed directly on, and into, a dryer 40. This type of a stationary siphon can be held in a straight alignment for installation. The assembly will assume the bent position after insertion into the dryer 40. The change from the straight position to the bent one may be accomplished by gravity or assisted by springs or other devices.

Properly installed the centerline of the joint and siphon assembly will closely agree with the centerline of the dryer cylinder 40. If this is true, there will be little or no movement of the stationary portion of the siphon 30 when the dryer cylinder 40 is rotating. Additionally, the siphon tip 31 will remain a nearly constant distance from the interior shell wall 42 of the dryer cylinder 40.

The foregoing description of the present invention has been presented for purposes of illustration and description. It is not intended to be exhaustive or to limit the invention to the precise form disclosed or to the materials in which the form may be embodied, and many modifications and variations are possible in light of the above teaching.

What is claimed is:

1. A device for use with a rotary joint and siphon comprising:

a siphon support having a first end and a second end, wherein said first end has an internal bearing surface for rotary engagement with said siphon, and wherein said siphon support includes an opening on a truncated cone section, said opening further being intermediate said first end and said second end for flow of fluid from an interior to an exterior of said siphon support.

2. The device of claim 1, wherein said siphon support has a cylinder section.

3. The device of claim 2, wherein said cylinder section is a right circular cylinder section.

4. A device for use with a rotary joint and siphon comprising:

a siphon support having a first end and a second end, wherein said first end has an internal bearing surface for rotary engagement with said siphon, and wherein said siphon support includes an opening intermediate said first end and said second end for flow of fluid from an interior to an exterior of said siphon support, further wherein said siphon support has a truncated cone section, wherein said truncated cone section is a right frusto-conical section.

5. A device for use with a rotary joint and siphon comprising:

a siphon support having a first end and a second end, wherein said first end has an internal bearing surface for rotary engagement with said siphon, and wherein said siphon support includes an opening intermediate said first end and said second end for flow of fluid from an interior to an exterior of said siphon support, further wherein said siphon support has a right frusto-conical section, wherein said internal bearing surface is on an interior of said truncated cone section.

6. A device for use with a rotary joint and siphon comprising:

a siphon support having a first end and a second end, wherein said first end has an internal bearing surface for rotary engagement with said siphon, and wherein said siphon support includes an opening intermediate said first end and said second end for flow of fluid from an interior to an exterior of said siphon support, further wherein said siphon support is a right frusto-conical section, wherein said opening is on said right frusto-conical section.

7. In a stationary siphon system for rotating heat exchanger rolls having an axis of rotation and a journal concentric to the axis of rotation, said stationary siphon system further includes a rotary joint which includes an inlet port for providing a flow of fluid, said siphon system comprising:

a siphon support with a plurality of openings extending between an exterior and an interior of said siphon support, said plurality of openings adapted to allow said flow of fluid between said rotary joint and an interior of said journal, further wherein said siphon support includes a right conical section; and a bearing rotatably attached to said siphon support.

8. The system of claim 7, wherein said bearing is adapted to attach to a siphon in which a return fluid passes therethrough.

9. The system of claim 7, wherein said right conical section is a frustum of a cone.

10. The system of claim 7, wherein an angle between an interior surface of said conical section and a centerline of a first section is less than about 90°.

11. The system of claim 7, wherein said siphon support is fixed to said rotary joint.

12. The system of claim 7, wherein said bearing is fixed to said siphon.

13. The system of claim 7, wherein a total area of said plurality of openings is about equal to, or greater than, an area defined by an annulus area between an exterior surface of said siphon and an interior surface of said siphon support proximate said rotary joint.

14. The system of claim 8, wherein said siphon is concentric with said siphon support.

15. The system of claim 7, wherein said plurality of openings are on a rotating portion of said siphon support.

16. A support device adapted for use with a rotary joint and stationary siphon system and rotating heat exchanger rolls having an axis of rotation and a journal concentric to the axis of rotation, wherein said rotary joint has an steam inlet pressure and a condensate outlet pressure wherein a pressure differential is measured between said inlet pressure and said outlet pressure, comprising:

a flow section adapted to receive steam from said rotary joint and transmit steam to said journal, wherein said flow section is further adapted to raise said pressure differential less than about 2 p.s.i.; and wherein said support device is only attached to a rotatable portion of said rotary joint and to a siphon pipe of said stationary siphon system.

17. The support device in claim 16, wherein said support device is rigidly attached to said rotatable portion of said rotary joint.

18. The support device of claim 16, wherein said support device is rotatably attached to said siphon pipe.

19. The support device of claim 16, wherein an interior portion of said flow section is a truncated cone section.

20. For use in a stationary siphon system and at least one rotating roll having an axis of rotation comprising:

a hollow support having at least one opening extending between an exterior and an interior thereof, said at least one opening adapted to allow a flow of steam from said interior of the hollow support to an interior of a journal of said rotating roll, wherein a sum of all areas of the at least one opening is defined, $A_T$;

said hollow support being further adapted to allow for a return condensate pipe to pass through said hollow support, wherein $D_3$ is defined as an exterior diameter of said return condensate pipe; and said hollow support having a first interior diameter, $D_1$, and said hollow support further adapted so that: $A_T \geqq \pi(D_1^2 - D_3^2)/4 \pm 10\%$.

21. The hollow support of claim 20, said hollow support further having a second interior diameter, $D_2$, wherein said hollow support is further adapted so that:

$$A_T \geqq \pi(D_1^2 - D_2^2)/4 \pm 10\%.$$

22. The hollow support of claim 20, wherein an interior portion of said hollow support is a truncated cone section.

23. The hollow support of claim 20, wherein said hollow support does not touch said at least one rotating roll.

24. The hollow support of claim 20, further wherein said hollow support is rigidly attached to a rotatable portion of a rotary joint.

25. The hollow support of claim 20, further wherein said hollow support is rotatably attached to said return condensate pipe.

26. A support device adapted for use with a portion of a papermaking system, said system including a rotary joint, a stationary siphon having a generally horizontal pipe section and a generally diagonal pipe section and an elbow therebetween, and a rotating heat exchange cylinder, wherein said stationary siphon has a first point of attachment to a stationary portion of said rotary joint thereby creating a first cantilever length of said siphon, said support device comprising:

a support point, wherein said support point attaches to a rotatable portion of said rotary joint and further rotatably attaches to said stationary siphon at a second point of attachment, thereby reducing said first cantilever length of said siphon, further wherein said second point of attachment is along said generally horizontal pipe section distal from said elbow; and said support device is only attached to said stationary siphon and said rotary joint.

27. The support device of claim 26, wherein said support device is rotatably attached to said stationary siphon.

28. The support device of claim 26, wherein said support device is rigidly attached to a rotatable portion of said rotary joint.

29. The support device of claim 26, wherein said support device further comprises a plurality of openings extending between an exterior and an interior of said support device, said plurality of opening adapted to allow a flow steam between said rotary joint and an interior of said rotating heat exchange cylinder.

30. A system for papermaking comprising:

a siphon support having a first end and a second end, wherein said first end has an internal bearing surface for rotary engagement only with a horizontal leg section of a stationary siphon, and wherein said siphon support includes an opening intermediate said first end and said second end for flow of fluid from an interior to an exterior of said siphon support, said opening further being located on a rotating portion of said support;

a rotating portion of a rotary joint fixedly attached to said siphon support; and a stationary portion of said rotary joint attached to said stationary siphon.

31. A method of assembly for use with a stationary siphon system comprising:

attaching a siphon support to a rotary joint, wherein said siphon support has a first end and a second end, wherein said first end has an internal bearing surface for rotary engagement with a siphon of said siphon system, and wherein said siphon support includes an opening intermediate said first end and said second end for flow of fluid from an interior to an exterior of said siphon support, further wherein said opening being located on a frusto-conical portion of said siphon support;

attaching said siphon to said rotary joint; and placing said siphon through said siphon support.

32. The method of claim 31, further comprising:

attaching said rotary joint to a heat exchanger roll.

* * * * *

UNITED STATES PATENT AND TRADEMARK OFFICE

CERTIFICATE OF CORRECTION

PATENT NO. : 7,018,513 B2
APPLICATION NO. : 10/395470
DATED : March 28, 2006
INVENTOR(S) : Jeffrey Smith It is certified that error appears in the above-identified patent and that said Letters Patent is hereby corrected as shown below:

Column 2
Line 2, delete "of" and insert -- off --

Column 9
Line 26, delete "An" and insert -- In --
Line 45, delete "in"

Column 10
Line 37, delete "that" and insert --than --

Column 12
Line 17, delete "an" and insert -- a --

Signed and Sealed this

First Day of August, 2006

JON W. DUDAS
*Director of the United States Patent and Trademark Office*